US011011869B2

(12) United States Patent
Sugio et al.

(10) Patent No.: US 11,011,869 B2
(45) Date of Patent: May 18, 2021

(54) CONNECTOR SEAL STRUCTURE

(71) Applicant: HONDA MOTOR CO., LTD., Tokyo (JP)

(72) Inventors: Daisuke Sugio, Wako (JP); Yuichi Takeda, Wako (JP); Koji Inose, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/497,818

(22) PCT Filed: Mar. 30, 2017

(86) PCT No.: PCT/JP2017/013468
§ 371 (c)(1),
(2) Date: Sep. 26, 2019

(87) PCT Pub. No.: WO2018/179291
PCT Pub. Date: Oct. 4, 2018

(65) Prior Publication Data
US 2020/0052434 A1 Feb. 13, 2020

(51) Int. Cl.
*H01R 24/60* (2011.01)
*H01R 13/52* (2006.01)
*H01R 107/00* (2006.01)

(52) U.S. Cl.
CPC ..... *H01R 13/5219* (2013.01); *H01R 24/60* (2013.01); *H01R 2107/00* (2013.01)

(58) Field of Classification Search
CPC ..... H01R 13/5219; H01R 2107/00; H01R 24/60; H01R 13/52; H01R 12/71
See application file for complete search history.

(56) References Cited

U.S. PATENT DOCUMENTS 4,711,509 A * 12/1987 Cross ..... H01R 13/424 439/271
5,100,335 A * 3/1992 Yamamoto ..... H01R 13/5219 439/271

(Continued)

FOREIGN PATENT DOCUMENTS

JP 2009-019725 1/2009
JP 2012-252858 6/2012

(Continued)

OTHER PUBLICATIONS

International Search Report and Written Opinion for International Application No. PCT/JP2017/013468 dated Jun. 13, 2017, 9 pages.

(Continued)

*Primary Examiner* — Truc T Nguyen
(74) *Attorney, Agent, or Firm* — Amin, Turocy & Watson, LLP

(57) ABSTRACT

The outer peripheral surface of a connector, to which a connector seal structure is applied, is provided with an engaging section that engages with a seal member. A rib of the engaging section locks the seal member in the inserting direction of the connector. The seal member is provided with a cutout section formed by cutting out a part of the rib, or a protruding section that engages with the rib.

6 Claims, 5 Drawing Sheets

(56) References Cited

U.S. PATENT DOCUMENTS

| | | | | |
|---|---|---|---|---|
| 5,618,206 | A * | 4/1997 | Sawada | H01R 13/5208 439/274 |
| 6,045,383 | A * | 4/2000 | Fujiwara | H01R 13/5219 439/271 |
| 6,338,651 | B1 * | 1/2002 | Svette, Jr. | H01R 13/5202 439/559 |
| 9,225,103 | B2 | 12/2015 | Okamoto et al. | |
| 9,812,801 | B2 | 11/2017 | Okura et al. | |
| 2005/0164550 | A1 * | 7/2005 | Drescher | H01R 13/4365 439/552 |
| 2013/0023140 | A1 * | 1/2013 | Kondo | H01R 13/5202 439/277 |
| 2013/0084728 | A1 * | 4/2013 | Omae | H01R 13/648 439/271 |
| 2013/0137285 | A1 * | 5/2013 | Miura | H01R 13/521 439/271 |
| 2013/0183844 | A1 | 7/2013 | Wang | |
| 2013/0316586 | A1 * | 11/2013 | Nagamine | H01R 13/4223 439/630 |

FOREIGN PATENT DOCUMENTS

| | | |
|---|---|---|
| JP | 2012-252858 | 12/2012 |
| JP | 2013-143378 | 7/2013 |
| JP | 2014-096264 | 5/2014 |
| JP | 2015-149268 | 8/2015 |
| JP | 2017-021899 | 1/2017 |

OTHER PUBLICATIONS

Japanese Office Action for Japanese Patent Application No. 2019-508067 dated Apr. 21, 2020.

Japanese Office Action for Japanese Patent Application No. 2019-508067 dated Aug. 11, 2020.

* cited by examiner

CONNECTOR SEAL STRUCTURE

TECHNICAL FIELD

The present invention relates to a connector sealing structure of a connector provided with a terminal portion.

BACKGROUND ART

For example, Japanese Laid-Open Patent Publication No. 2017-021899 discloses placing a sealing member in the shape of a continuous ring (belt) on the outer circumferential surface of a connector member covering a terminal portion that is connectable to a connecting object. In this case, the sealing member is placed in a groove portion formed in the outer circumferential surface of the connector member, and a locking structure is provided in a connector, the locking structure curbing sliding of the sealing member in a direction in which the connector is inserted into the object and rotation of the sealing member in the circumferential direction of the connector.

SUMMARY OF INVENTION

However, such a locking structure makes it necessary to produce the connector in such a way that the sealing member engages in the groove portion in a state in which the shape of the groove portion and the shape of the sealing member substantially match with each other. As a result, a sophisticated technology is required in terms of production.

Thus, an objective of the present invention is to provide a connector sealing structure that can curb, with a simple structure, sliding of a sealing member of a connector in a direction in which the connector is inserted and rotation of the sealing member in the circumferential direction of the connector.

The present invention is a connector sealing structure of a connector provided with a terminal portion that is connected to a connecting object, and has the features below.

A first feature; the connector sealing structure includes a sealing member that is placed on the outer circumferential surface of the connector and an engaging portion that is provided on the outer circumferential surface of the connector and engages the sealing member. In this case, the engaging portion is configured with a rib that locks the sealing member in a direction in which the connector is inserted into the connecting object and a notch portion that is formed by cutting out part of the rib. Moreover, in the sealing member, a projection that engages the notch portion or the rib is provided.

A second feature; the terminal portion is a plate-like member having a plurality of contact portions provided on a plane and at least part of the notch portion is formed on an end side in the longitudinal direction of the plane in the connector.

A third feature; when viewed from the direction in which the connector is inserted, the thickness of a region where the projection is provided in the sealing member is larger than the thickness of the other regions of the sealing member.

A fourth feature; the rigidity of the projection is higher than the rigidity of the other regions of the sealing member.

A fifth feature; in the projection, a supporting member that supports the projection is provided.

A sixth feature; the supporting member is provided inside the projection.

According to the first feature of the present invention, with a simple structure in which the projection of the sealing member is made to engage the notch portion or the rib, which constitutes the engaging portion, it is possible to regulate both sliding of the sealing member in the direction in which the connector is inserted into the connecting object and rotation of the sealing member in the circumferential direction of the connector.

According to the second feature of the present invention, since at least part of the notch portion is formed on an end side of the connector along the longitudinal direction, the notch portion and the contact portions are provided in a state in which the notch portion and the contact portions are separated from each other. This makes it possible to curb the influence of the notch portion on the contact portions.

According to the third feature of the present invention, by making thick a region of the projection to which a stress is applied in the circumferential direction, it is possible to curb rotation of the sealing member in the circumferential direction effectively.

According to the fourth feature of the present invention, by making the projection, to which a stress is applied in the circumferential direction, possess high rigidity, it is possible to curb rotation of the sealing member in the circumferential direction effectively.

According to the fifth feature of the present invention, by providing the supporting member in the projection to which a stress is applied in the circumferential direction, it is possible to curb rotation of the sealing member in the circumferential direction effectively.

According to the sixth feature of the present invention, since the supporting member is provided inside the projection, rotation of the sealing member in the circumferential direction can be easily curbed.

DESCRIPTION OF EMBODIMENTS

A preferred embodiment of a connector sealing structure according to the present invention will be described in detail with reference to the attached drawings.

Configuration of the Present Embodiment

Figure 1:
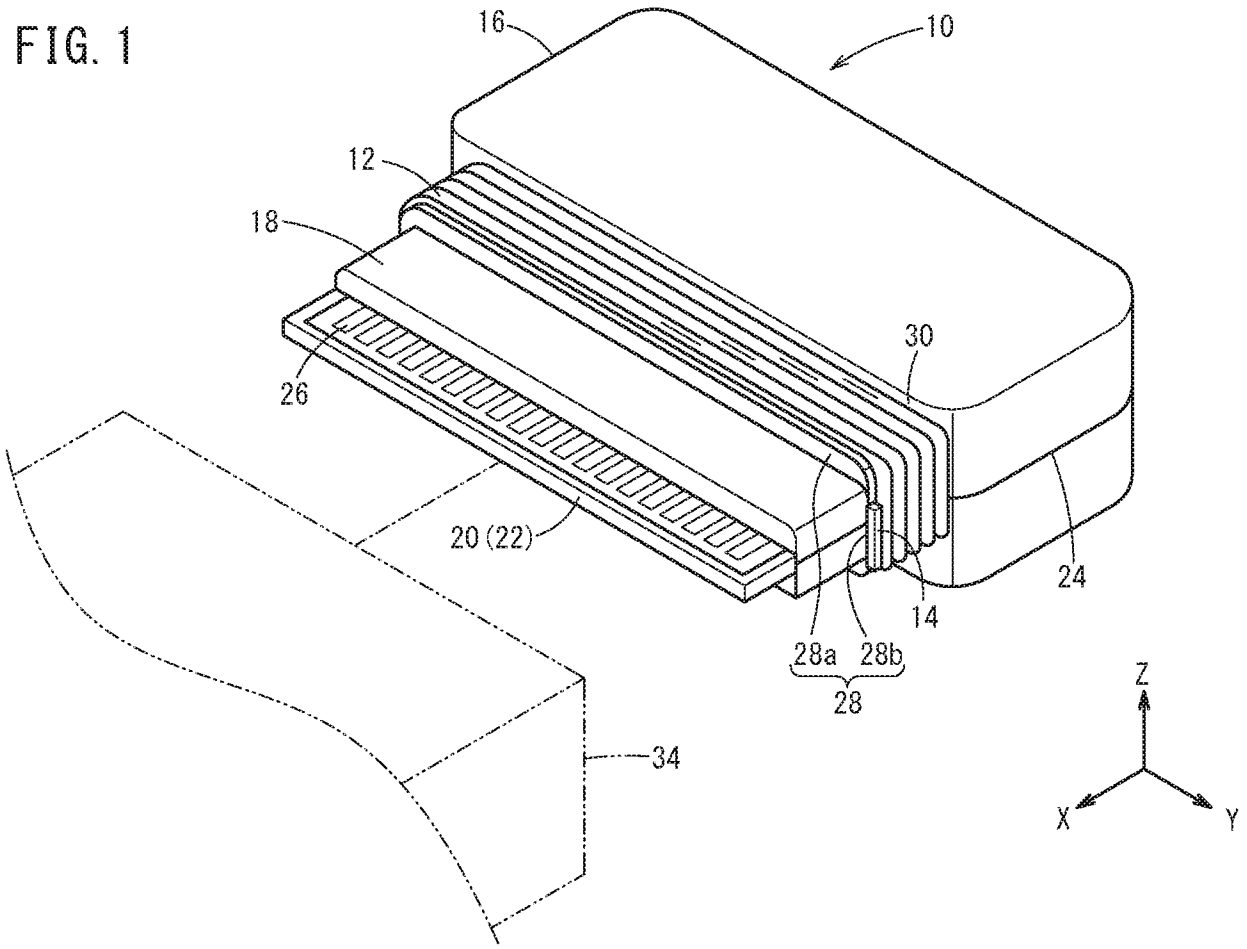
FIG. 1 is a perspective view of a connector to which a connector sealing structure according to the present embodiment is applied.
Figure 2:
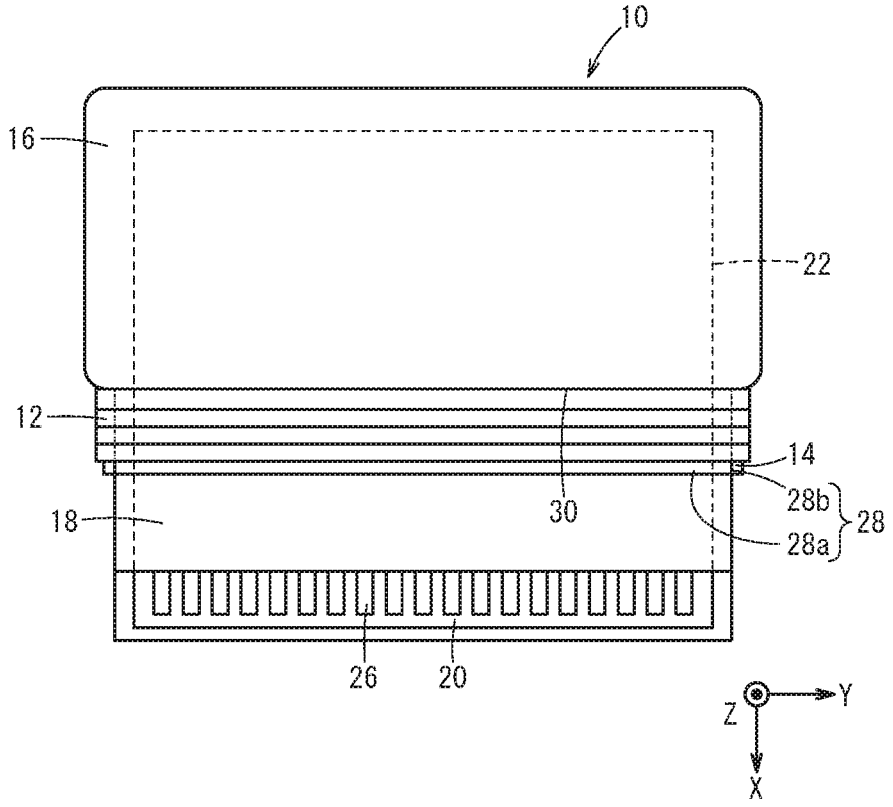
FIG. 2 is a plan view of the connector of FIG. 1.
Figure 3:
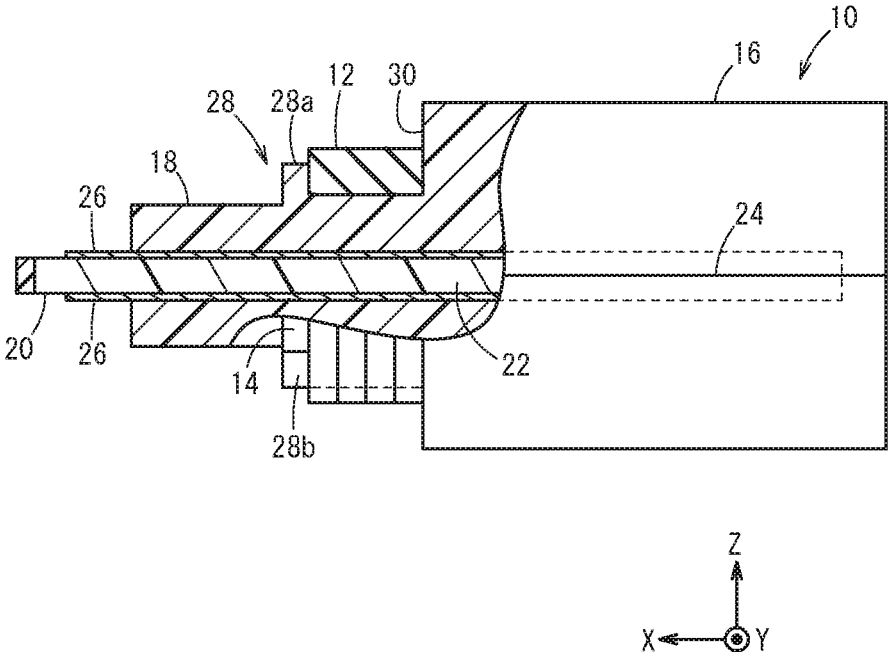
FIG. 3 is a side view of the connector depicting part of the connector in a cutaway.
Figure 4:
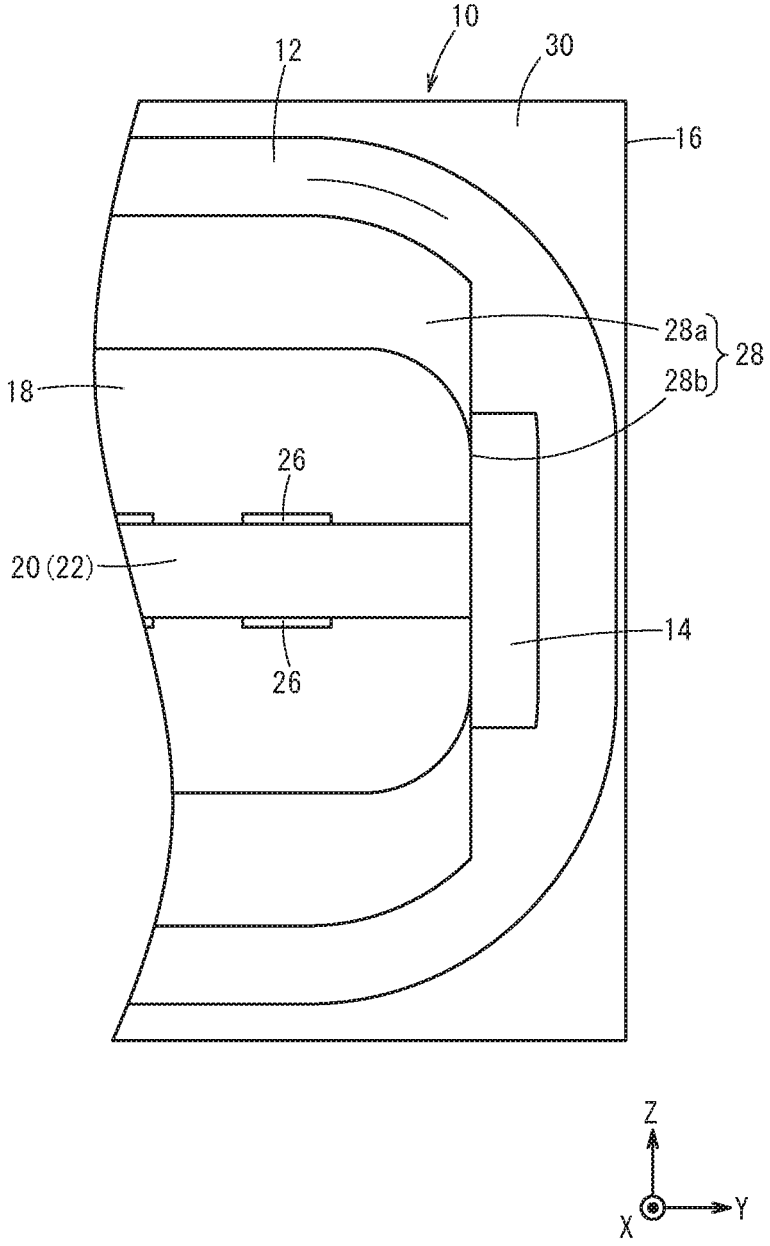
FIG. 4 is a partial front view of the connector scaling up an area in the proximity of a projection of a sealing member of FIG. 1.

FIGS. 1 to 3 are a perspective view, a plan view, and a side view, respectively, of a connector 10 to which the connector sealing structure according to the present embodiment is applied. Moreover, FIG. 4 is a partial front view of the connector 10 scaling up an area in the proximity of a projection 14 that constitutes a sealing member 12 placed on the outer circumferential surface of the connector 10.

As depicted in FIGS. 1 to 3, the connector 10 is a male connector including a substantially rectangular housing main body 16, a substantially rectangular protruding portion 18 that protrudes from the housing main body 16 in a +X direction (an arrow direction on an X-axis in FIGS. 1 to 3), a plate-like terminal portion 20 that extends from the tip of the protruding portion 18 in the +X direction, and a sealing member 12 that is placed on the outer circumferential surface of the protruding portion 18.

Both the housing main body 16 and the protruding portion 18 smaller than the housing main body 16 are made of resin and formed by (integral) casting. That is, a card substrate 22 that is a plate-like member made of resin is placed between an upper die and a lower die of an unillustrated mold, and resin is poured into the mold and cured, so that the housing main body 16 and the protruding portion 18 are formed by casting, surrounding the card substrate 22. In this case, an end of the card substrate 22 *t* protrudes from the protruding portion 18 in the +X direction is configured as a terminal portion 20.

Moreover, as a result of the housing main body 16 and the protruding portion 18 being formed by casting by using the upper die and the lower die, in each side face of the housing main body 16 and the protruding portion 18, burr 24 which is a parting line is formed in a central part in a Z direction. It is desirable to remove the burr 24 by predetermined processing after casting. In this case, as a result of the burr 24 being removed at least from an area the sealing member 12 crosses, among areas at both ends of the protruding portion 18 in a Y direction (the longitudinal direction of the planar terminal portion 20), sealing performance of the connector 10 is enhanced. In FIG. 1, an example in which the burr 24 is removed only from the areas crossed by the sealing member 12 is illustrated. It goes without saying that it is more preferable that all the burr 24 that is formed on the side faces of the housing main body 16 and the protruding portion 18 is removed.

The terminal portion 20 is a planar plate-like member that extends in an X direction (a direction in which the connector 10 is inserted) and a Y direction and is thinner than the housing main body 16 and the protruding portion 18. On the upper face and the bottom face of the terminal portion 20, a plurality of electrically conductive contact portions 26, which extend in the X direction and are arranged in the Y direction at predetermined intervals, are formed.

In an area on the outer circumferential surface of the protruding portion 18 that is closer to the housing main body 16, a ring-shaped sealing member 12 is provided. The sealing member 12 is also band-shaped, having sealing performance. The sealing member 12 is, for example, rubber. In this case, on the outer circumferential surface of the protruding portion 18, an engaging portion 28 that engages the sealing member 12 is provided. The engaging portion 28 is configured with a rib 28*a* that is formed in the circumferential direction of the protruding portion 18 so as to face a +X direction side front-end face 30 of the housing main body 16, and a notch portion 28*b* that is a portion where part of the rib 28*a* has been cut out at opposite ends of the protruding portion 18 in the Y direction. As a result, the sealing member 12 is provided between the front-end face 30 of the housing main body 16 and the rib 28*a*, which is a wall portion provided with a predetermined space in the X direction.

The notch portion 28*b* is formed as a flat part that is substantially parallel to the Z direction as a result of both ends of the protruding portion 18 and the rib 28*a* being shaven and the burr 24 being removed. Alternatively, the notch portion 28*b* may be formed by configuring an upper die and a lower die in advance to have a shape by which the notch portion 28*b* is formed and forming the housing main body 16 and the protruding portion 18 by casting by using such an upper die and lower die. In this case, by removing the burr 24 of the notch portion 28*b* thus formed, the flat part that is substantially parallel to the Z direction is formed.

As a result of the notch portion 28*b* being formed in this manner, at both ends of the protruding portion 18, a contact part in the sealing member 12 where the sealing member 12 is in contact with the outer circumferential surface (the notch portion 28*b*) of the protruding portion 18 is visually recognized in a front view of FIG. 4. Therefore, it appears that this contact part is thicker than the other regions of the sealing member 12.

In addition, in this contact part (thick part), a projection 14 projecting in the +X direction is provided. The projection 14 is a rectangular protruding portion extending in the Z direction and is provided in the sealing member 12 so as to be in contact with the notch portion 28*b*. The projection 14 may be provided in the sealing member 12 in such a way that a slight clearance is formed between the projection 14 and the notch portion 28*b*.

Figure 5:
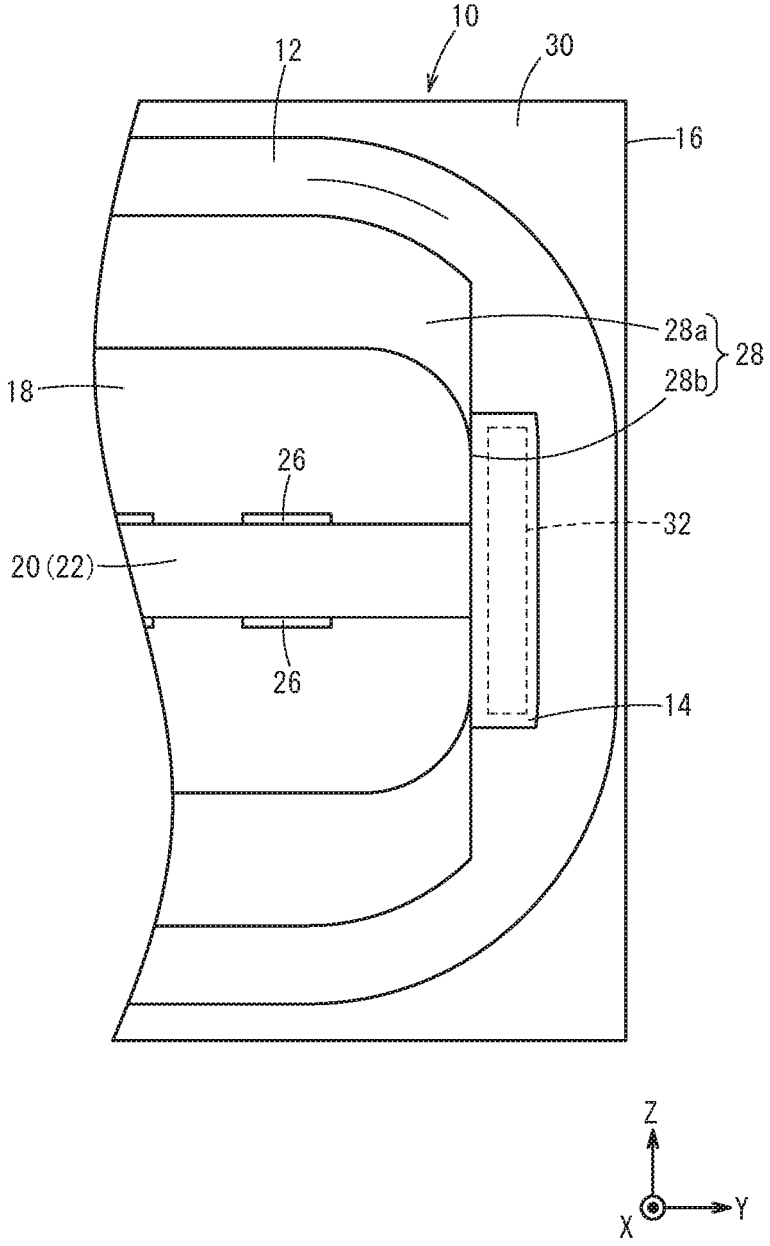
FIG. 5 is a partial front view of the connector, the partial front view depicting another configuration example of FIG. 4.

Here, it is preferable that the projection 14 possesses higher rigidity than the other regions of the sealing member 12. Alternatively, as depicted in FIG. 5, the projection 14 may be made to possess higher rigidity than the other regions of the sealing member 12 by providing, inside the projection 14, a supporting member 32 which is a rigid body, such as resin, whose rigidity is higher than those of the other regions of the sealing member 12.

Workings of the Present Embodiment

The workings of the connector 10 configured as described above will be described.

As depicted in FIG. 1, in a state in which the terminal portion 20 of the connector 10 and a female connector 34, which is a connecting object, are made to face each other, the connector 10 is moved in the +X direction and the terminal portion 20 and the protruding portion 18 are inserted into an unillustrated opening of the connector 34. This makes the terminal portion 20 engage in a female terminal portion in the opening, and the contact portions 26 of the terminal portion 20 and a plurality of contact portions provided in the female terminal portion make contact with each other. Meanwhile, a clearance between the protruding portion 18 and the opening of the connector 34 is sealed by the sealing member 12. As a result, the connector 10 and the connector 34 are connected.

In this case, on the outer circumferential surface of the protruding portion 18, the sealing member 12 is provided between the rib 28*a* formed in the protruding portion 18 and the front-end face 30 of the housing main body 16. As a result, the sealing member 12 is positioned in the X direction and sliding thereof in the X direction is curbed.

Moreover, the projection 14 extends from the sealing member 12 in the +X direction and is close to the rib 28*a* and the notch portion 28*b*. Thus, if the sealing member 12 rotates in the circumferential direction (of the protruding portion 18) of the connector 10, the projection 14 makes contact with the notch portion 28*b* or the rib 28*a* or both. As a result, rotation of the sealing member 12 in the circumferential direction is curbed. Furthermore, since the projection 14 is thick and the projection 14 possesses high rigidity or the supporting member 32 provided inside the projection 14 possesses high rigidity, when the sealing member 12 rotates in the circumferential direction of the protruding portion 18, the projection 14 makes contact with the notch portion 28*b* or the rib 28*a* or both; therefore, even when a stress in the circumferential direction is applied to a region near the projection 14 in the sealing member 12, it is possible to curb rotation of the sealing member 12 in the circumferential direction effectively.

When the housing main body 16 of the connector 10 is pulled in a −X direction (a direction opposite to the arrow direction on the X-axis in FIGS. 1 to 3), the terminal portion 20 is separated from the female terminal portion of the connector 34, and the terminal portion 20 and the protruding portion 18 can be detached from the opening of the connector 34. As a result, the connected state between the connector 10 and the connector 34 is lifted.

Effects of the Present Embodiment

As described above, with the connector sealing structure (the connector 10) according to the present embodiment, a simple structure in which the projection 14 of the sealing member 12 is made to engage the notch portion 28*b* or the rib 28*a*, which constitutes the engaging portion 28, can regulate both sliding of the sealing member 12 in the direction (the X direction) in which the connector 10 is inserted into the connector 34 and rotation of the sealing member 12 in the circumferential direction of the connector 10.

Moreover, since at least part of the notch portion 28*b* is formed at both ends of the protruding portion 18 in the Y direction, the notch portion 28*b* and the contact portions 26 are provided in a state in which the notch portion 28*b* and the contact portions 26 are separated from each other. This makes it possible to curb the influence of the notch portion 28*b* on the contact portions 26.

Furthermore, in the sealing member 12, by making thick a region of the projection 14 to which a stress is applied in the circumferential direction of the connector 10, making the projection 14, to which a stress is applied in the circumferential direction, possess high rigidity, or providing the supporting member 32 in the projection 14 to which a stress is applied in the circumferential direction, it is possible to curb rotation of the sealing member 12 in the circumferential direction effectively.

In this case, if the supporting member 32 is provided inside the projection 14, rotation of the sealing member 12 in the circumferential direction of the connector 10 can be easily curbed. The present embodiment is not limited to a configuration in which the supporting member 32 is provided inside the projection 14, and any other supporting methods for the projection 14 can be adopted as long as the methods can make the projection 14 possess higher rigidity than the other regions of the sealing member 12.

While the present invention has been described above by using the preferred embodiment thereof, the technical scope of the present invention is not limited to the above description of the embodiment. It is obvious to a person skilled in the art that various changes or improvements can be made to the above-described embodiment. As is clear from the description of the claims, any embodiment obtained by making such changes or improvements to the above-described embodiment can also be included in the technical scope of the present invention. Moreover, characters in parentheses described in the claims are the same as the characters in the attached drawings to facilitate understanding of the present invention and are not meant to limit the present invention to the elements identified with these characters.

The invention claimed is:

1. A connector sealing structure of a connector provided with a terminal portion that is connected to a connecting object, the connector sealing structure comprising:
- the connector includes
  - a housing main body,
  - a protruding portion that protrudes from the housing main body toward the connecting object, and
  - the terminal portion that extends from the protruding portion toward the connecting object,
- the connector sealing structure includes
  - a sealing member that is placed on an outer circumferential surface of the protruding portion; and
  - an engaging portion that is provided on the outer circumferential surface of the protruding portion and engages the sealing member, wherein
  - the engaging portion includes
    - a rib that is formed on the outer circumferential surface of the protruding portion and locks the sealing member in a direction in which the connector is inserted into the connecting object, and
    - a notch portion that is formed by cutting part of the rib out of at least a site that belongs to a side surface of the protruding portion along the direction and faces the sealing member, the notch portion being substantially flat in a direction perpendicular to the direction,
- the sealing member is provided between the housing main body and the rib on the outer circumferential surface of the protruding portion,
- in the sealing member, a projection that protrudes toward the connecting object along the direction and engages the notch portion or the rib is provided, and
- when viewed from the direction in which the connector is inserted, a thickness in a radial direction of the sealing member in a region where the projection is provided in the sealing member is larger than a thickness in the radial direction of other regions of the sealing member.

2. The connector sealing structure according to claim 1, wherein
- the terminal portion is a plate-like member having a plurality of contact portions provided on a plane, and
- at least part of the notch portion is formed on an end side in a longitudinal direction of the plane in the protruding portion.

3. The connector sealing structure according to claim 1, wherein
- rigidity of the projection is higher than rigidity of other regions of the sealing member.

4. The connector sealing structure according to claim 1, wherein
- in the projection, a supporting member that supports the projection is provided.

5. The connector sealing structure according to claim 4, wherein
- the supporting member is provided inside the projection.

6. A connector sealing structure of a connector provided with a terminal portion that is connected to a connecting object, the connector sealing structure comprising:
- the connector includes
  - a housing main body,
  - a protruding portion that protrudes from the housing main body toward the connecting object, and
  - the terminal portion that extends from the protruding portion toward the connecting object,
- the connector sealing structure includes
  - a sealing member that is placed on an outer circumferential surface of the protruding portion; and an engaging portion that is provided on the outer circumferential surface of the protruding portion and engages the sealing member, wherein the engaging portion includes:

a rib that is formed on the outer circumferential surface of the protruding portion and locks the sealing member in a direction in which the connector is inserted into the connecting object, and a notch portion that is formed by cutting part of the rib, the sealing member is provided between the housing main body and the rib on the outer circumferential surface of the protruding portion, in the sealing member, a projection that protrudes toward the connecting object along the direction and engages the notch portion or the rib is provided.

* * * * *